US005929839A

United States Patent [19]

Matsumoto

[11] Patent Number: 5,929,839

[45] **Date of Patent: *Jul. 27, 1999**

[54] IMAGE DISPLAY CONTROL APPARATUS

[75] Inventor: Seiji Matsumoto, Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/775,207

[22] Filed: Dec. 30, 1996

[30] Foreign Application Priority Data

Aug. 9, 1996 [JP] Japan ..... 8-211539

[51] Int. Cl.[6] ..... G09G 5/22

[52] U.S. Cl. ..... 345/141; 345/150; 345/26

[58] Field of Search ..... 345/25, 26, 141, 345/144, 150; 348/589

[56] References Cited

U.S. PATENT DOCUMENTS 3,911,418 10/1975 Takeda ..... 345/150
3,918,039 11/1975 Clark ..... 345/144
4,704,699 11/1987 Farina et al. ..... 345/199
5,467,109 11/1995 Nagaoka ..... 345/141
5,784,038 7/1998 Irwin ..... 345/88

FOREIGN PATENT DOCUMENTS 5-181447 7/1993 Japan .

*Primary Examiner*—Jeffery Brier
*Attorney, Agent, or Firm*—Burns, Doane, Swecker, & Mathis, LLP

[57] ABSTRACT

An image display control apparatus which can achieve multicolor display for each font. It includes a first memory for storing red, green and blue pattern codes forming an image pattern, a second memory in which bitmap type image pattern data corresponding to the pattern codes have been stored, first, second and third buffers for temporarily storing the image pattern data, first, second and third serial output circuits for serially outputting data delivered from the first, second and third buffers, and a display control circuit for controlling such that the red, green and blue image pattern data are sequentially stored in the first, second and third buffers.

7 Claims, 8 Drawing Sheets

| | |
|---|---|
| (a) | = RED |
| (b) | = BLUE |
| (c) | = GREEN |
| (d) | = BLACK |
| (e) | = RED+BLUE=MAGENTA |
| (f) | = RED+GREEN=YELLOW |
| (g) | = BLUE+GREEN= CYAN |

IMAGE DISPLAY CONTROL APPARATUS

BACKGROUND OF THE INVENTION

1. Field of the Invention

The present invention relates to an image display control apparatus for controlling display of images such as characters on a display like a CRT.

2. Description of Related Art

FIG. 11 illustrates digits superimposed on a window to be displayed on a display such as a CRT by using a conventional image display control apparatus. In this figure, the reference numeral 40 designates a screen, and 41 designates a window for displaying characters like digits. The reference characters C1 and C2 each designate display areas of first and second characters. The conventional image display control apparatus designates each character by one bitmap data and one color data. Accordingly, each of the digits "1" and "2" is monochromatically displayed in the display areas C1 and C2. In other words, multicolor display is impossible in each display area corresponding to one of the characters. One example of such conventional image display control apparatus is disclosed in JP-A 5-181447/1993.

Thus, the conventional image display control apparatus with the above-mentioned arrangement has a problem in that it cannot carry out multicolor display in each display area corresponding to each one of the characters.

SUMMARY OF THE INVENTION

It is therefore an object of the present invention to eliminate the problem to provide an image display control apparatus which can achieve multicolor display in each display area, and in addition, which can perform edging processing by effectively utilizing parts in a monochromatic display mode when the control apparatus has two display modes, a multicolor mode and a monochromatic mode.

An image display control apparatus in accordance with the present invention comprises: a first memory for storing a red pattern code, a green pattern code and a blue pattern code, which designate an image pattern; a second memory including bitmap type red image pattern data, bitmap type green image pattern data and bitmap type blue image pattern data, the red image pattern data, green image pattern data and blue image pattern data corresponding to the red pattern code, green pattern code and blue pattern code stored in the first memory, respectively, the second memory outputting red image pattern data, green image pattern data and blue image pattern data corresponding to the red pattern code, green pattern code and blue pattern code input to the second memory from the first memory; and output means for sequentially outputting the red image pattern data, green image pattern data and blue image pattern data which are delivered from the second memory in accordance with their color.

Here, the output means may comprise a first buffer for temporarily storing the red image pattern data, a second buffer for temporarily storing the green image pattern data, a third buffer for temporarily storing the blue image pattern data, first serial output means for serially outputting data delivered from the first buffer, second serial output means for serially outputting data delivered from the second buffer, and third serial output means for serially outputting data delivered from the third buffer, and the image display control apparatus may further comprise display control means for controlling the red image pattern data, green image pattern data and blue image pattern data, which are output from the second memory in time sharing manner, such that they are sequentially stored into the first buffer, the second buffer and the third buffer.

The second memory may comprise a counter for counting pulses of a horizontal synchronizing signal, and an addressing circuit for addressing bitmap type image pattern data for one line stored in the memory area, in response to a count value of the counter, and the red pattern code, green pattern code and blue pattern code output from the first memory.

The display control means may control such that the red image pattern data, green image pattern data and blue image pattern data, which are associated with the image pattern, are stored in the first buffer, second buffer and third buffer, respectively, before a period during which the image pattern is displayed, and may control such that the red image pattern data, green image pattern data and blue image pattern data are output bit by bit from the first serial output means, second serial output means and third serial output means, respectively, during the period.

The image display control apparatus may further comprise image display mode designating means for designating one of a monochromatic display mode in which an image pattern to be displayed is designated by a single pattern code and a single color code, and a multicolor display mode in which an image pattern to be displayed is designated by a red pattern code, a green pattern code and a blue pattern code, wherein in the monochromatic display mode, the first memory stores a pattern code and a color code which designate an image pattern, the memory area of the second memory stores bitmap type image pattern data which correspond to the pattern code for designating the image pattern, and the control means controls such that the image pattern data output from the second memory is delivered to one of the first buffer, the second buffer and the third buffer, and wherein the image display control apparatus further comprises color processing means for coloring in the monochromatic display mode image pattern data output from the serial output means corresponding to the one of the buffers in accordance with the color code stored in the first memory.

The image display control apparatus may further comprise edging data generating means for generating edging data for edging in the monochromatic display mode an image pattern in response to image pattern data delivered from the second memory, wherein the display control means controls in the monochromatic display mode the edging data generated by the edging data generating means such that the edging data is stored in a buffer other than the one of the buffers, and such that the stored edging data is output bit by bit from the serial output means corresponding to the buffer other than the one of the buffers, and wherein the image display control apparatus comprises edge display processing means for carrying out edge display processing of the image pattern output from the serial output means corresponding to the one of the buffers in accordance with the edging data.

According to the present invention, since the bitmap type image pattern data, which correspond to the red, green and blue patterns designating the image pattern, are sequentially output in the time sharing fashion, an advantage is obtained that the multicolor display can be implemented in one display area corresponding to each one of characters or the like.

Furthermore, since the second memory includes the counter for counting pulses of the horizontal synchronizing signal, and the addressing circuit for addressing bitmap type image pattern data for one line stored in the memory area, in response to the count value of the counter, and the red pattern code, green pattern code and blue pattern code output from the first memory, an advantage is offered that the multicolor display is achieved for each line in one display area, independently.

Moreover, since the image pattern data are stored in the first, second and third buffers before the period during which the image data stored in the second memory are actually displayed, and are transferred to the serial output means just before the actual display period so that the image pattern data are output bit by bit from the serial output means during the actual display period, an advantage is achieved that the multicolor display is performed without interruption.

In addition, since the image display control apparatus is configured such that it includes the monochromatic display mode in which an image pattern to be displayed is designated by a single pattern code and a single color code, and the multicolor display mode in which an image pattern to be displayed is designated by a red pattern code, a green pattern code and a blue pattern code, and that one of the two modes can be selected by switching, it becomes possible to perform the multicolor display only on necessary portions, which offers an advantage that the multicolor display can be achieved in the display area with reduced memory size.

Furthermore, since the edging processing is carried out by utilizing the buffer and the serial output means which are not used in the monochromatic display mode, an advantage is obtained that the edging processing is implemented by effectively utilizing the parts in the monochromatic display mode.

DETAILED DESCRIPTION OF THE PREFERRED EMBODIMENTS

The invention will now be described with reference to the accompanying drawings.

EMBODIMENT 1

Figure 1:
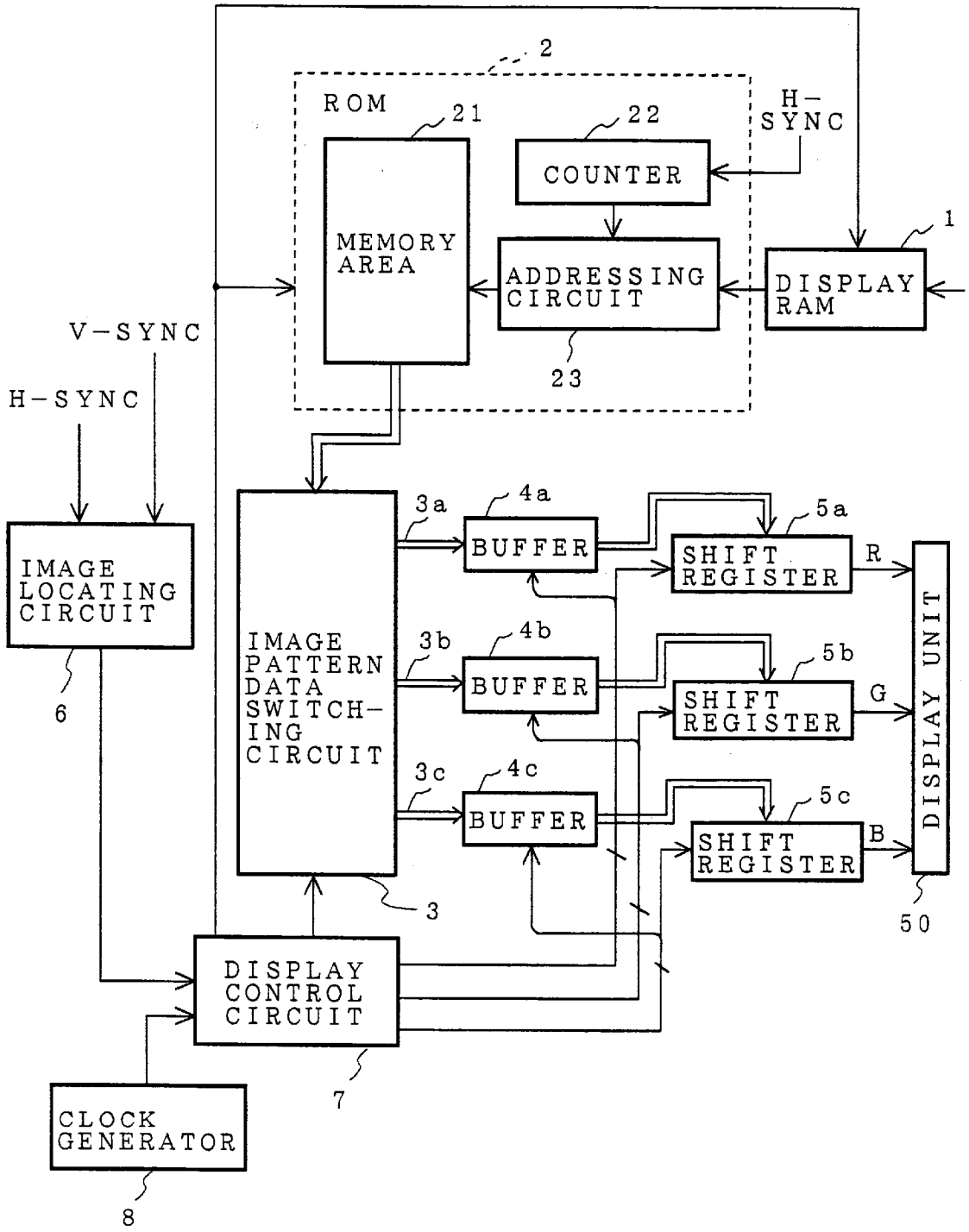
FIG. 1 is a block diagram showing a first embodiment of an image display control apparatus in accordance with the present invention.

FIG. 1 is a block diagram showing the configuration of a first embodiment of the image display control apparatus in accordance with the present invention. In this figure, the reference numeral 1 designates a display RAM (first memory) for storing R (Red) pattern codes, G (Green) pattern codes and B (Blue) pattern codes representing R, G and B signals for each scanning line of an image pattern, respectively. The reference numeral 2 designates a ROM (second memory) for prestoring bitmap type image pattern data corresponding to the R pattern codes, G pattern codes and B pattern codes for each scanning line of each image pattern. The reference numeral 3 designates an image pattern data switching circuit (display control means) for switching in a time sharing manner the image pattern data delivered from the ROM 2 to be output from output terminals 3*a*, 3*b* and 3*c*. Reference numerals 4*a*, 4*b* and 4*c* designate buffers for temporarily storing image pattern data output from the output terminals 3*a*, 3*b* and 3*c* of the image pattern data switching circuit 3. Reference numerals 5*a*, 5*b* and 5*c* are shift registers (serial output means) for storing the image pattern data delivered from the buffers 4*a*, 4*b* and 4*c*, and for outputting them bit by bit as R, G and B signals. The reference numeral 6 designates an image locating circuit for identifying the location of a current display image on the screen by the vertical synchronizing signal V-SYNC and the horizontal synchronizing signal H-SYNC input thereto. The reference numeral 7 designates a display control circuit (display control means) for controlling operation timings or the like of the display RAM 1, ROM 2, image pattern data switching circuit 3, buffers 4*a*, 4*b* and 4*c*, and shift registers 5*a*, 5*b* and 5*c*. The reference numeral 8 designates a clock generator for supplying the display control circuit 7 with a reference clock signal.

The ROM 2 comprises a memory area 21 for storing the bitmap type image pattern data, a counter 22 for counting the number of pulses of the input horizontal synchronizing signal H-SYNC, and an addressing circuit 23 for supplying the memory area 21 with a signal designating the addresses of data to be read in response to the R, G and B pattern codes output from the display RAM 1 and the count value of the counter 22.

Next, the operation will be described.

Figures 2, 3:
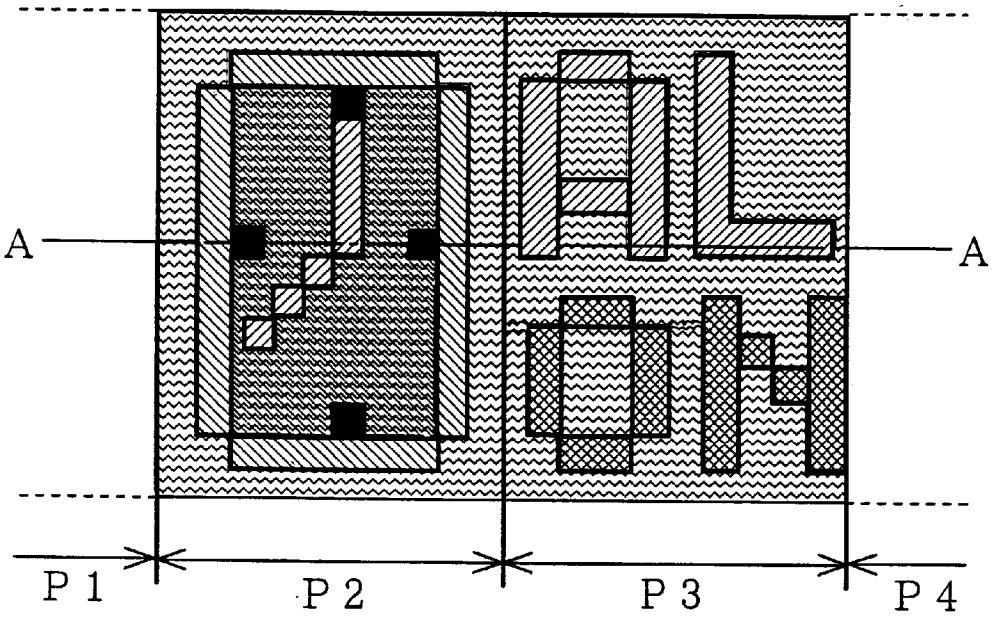
FIG. 2 illustrates an image displayed on a screen of a display unit when the image display control apparatus is used of the configuration as shown in FIG. 1.
FIG. 3 is a diagram showing the relationships between shading patterns and colors of the image as shown in FIG. 2.

FIG. 2 is a diagram illustrating an image displayed on the screen of a display unit when the image display control apparatus is used with a configuration as shown in FIG. 1. This figure illustrates two image patterns displayed on the screen. FIG. 3 is a table showing colors of the images illustrated in FIG. 2. As shown in this table, (a), (b), (c) and (d) show red, blue, green and black, respectively, and (e), (f) and (g) show magenta, yellow and cyan which are obtained. by combining two of the three colors, red, blue and green.

Figure 4:
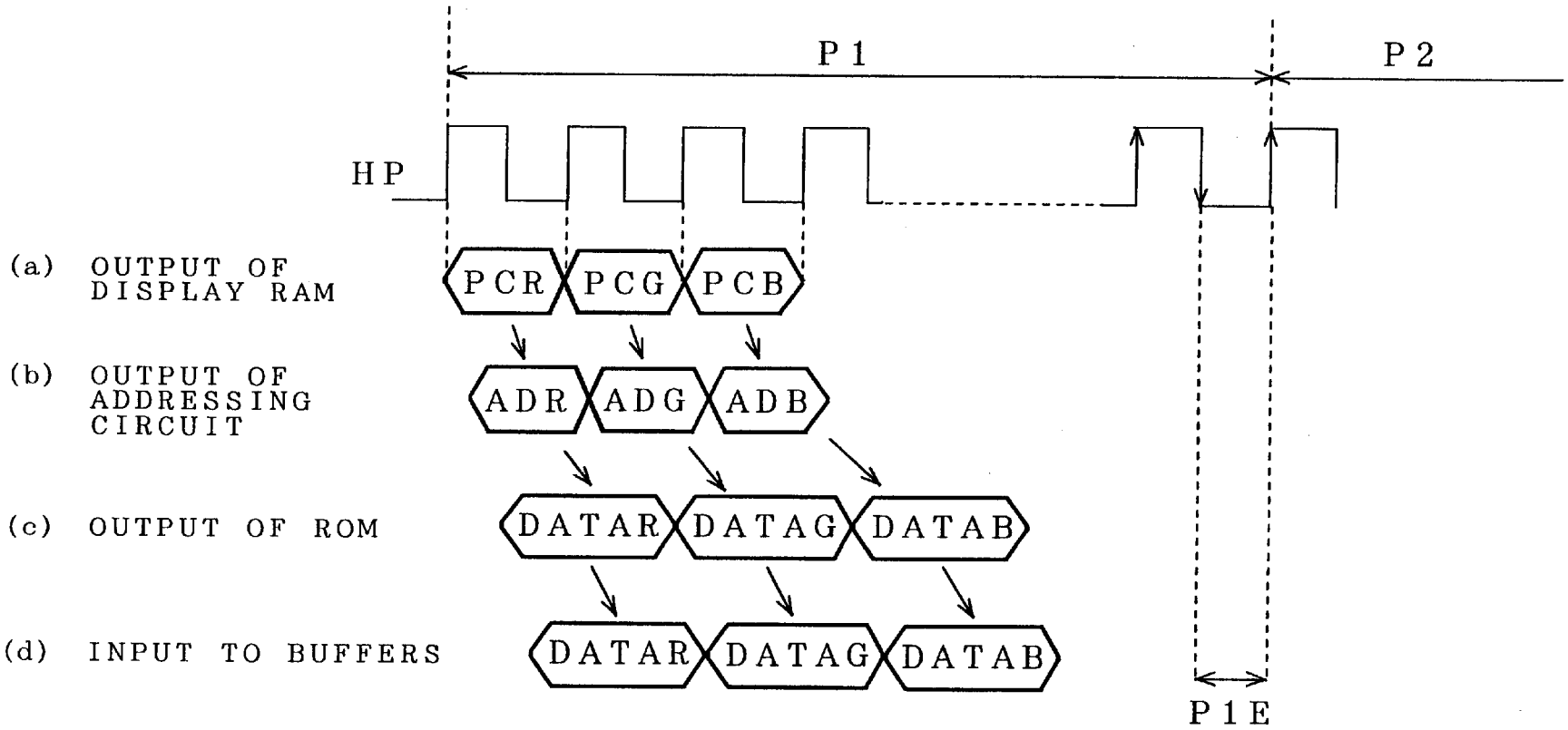
FIG. 4 is a timing chart illustrating a horizontal display pulse train for determining display timings of individual dots in a horizontal direction of an image pattern generated by a display control circuit, and timings of input and output signals of various portions of the first embodiment in accordance with the present invention as shown in FIG. 1.

FIG. 4 is a timing chart illustrating the timing of the horizontal display pulse train HP for determining the display timing of individual dots in the horizontal direction of the image pattern, which display timing is generated by the display control circuit 7, and the timings of input and output signals of various portions of FIG. 1. Specifically, waveform (a) illustrates the output timings of the R pattern code PCR, G pattern code PCG and B pattern code PCB, which are output from the display RAM 1; waveform(b) illustrates the output timings of addresses ADR, ADG and ADB of the memory area 21, which are output from the addressing circuit 12 in correspondence to the R pattern code PCR, G pattern code PCG and B pattern code PCB, respectively; waveform(c) illustrates the output timings of the image pattern data DATAR, DATAG and DATAB which are stored in the addresses ADR, ADG and ADB of the ROM 2; and waveform(d) illustrates the timings at which the image pattern data DATAR, DATAG and DATAB output from the ROM 2 are stored into the buffers 4*a*, 4*b* and 4*c*. The period P1 designates the display interval associated with a single image pattern area.

Figure 5:
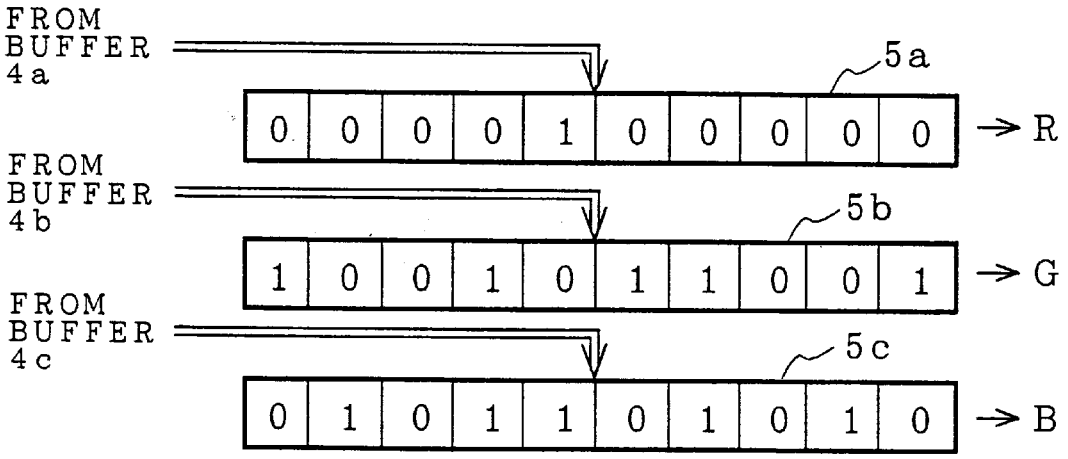
FIG. 5 is a diagram illustrating image pattern data of an image pattern to be displayed, which are stored in shift registers.

Next, the operation will be described of a case where the second image pattern area of FIG. 2 is displayed along the horizontal scanning line A–A' in the display area P2. As shown in FIG. 4, the image pattern data of each scanning line in the period P2 are stored into the buffers 4*a*, 4*b* and 4*c* during the period P1, and then stored in the shift registers 5*a*, 5*b* and 5*c* during the period P1E ranging from the falling edge of the final horizontal display pulse HP in the period P1 to the rising edge of the first horizontal display pulse HP in the period P2. FIG. 5 illustrates the state in which the image pattern data DATAR, DATAG and DATAB to be displayed during the period P2 are stored in the shift registers 5*a*, 5*b* and 5*c* during the period P1E.

Figure 6:
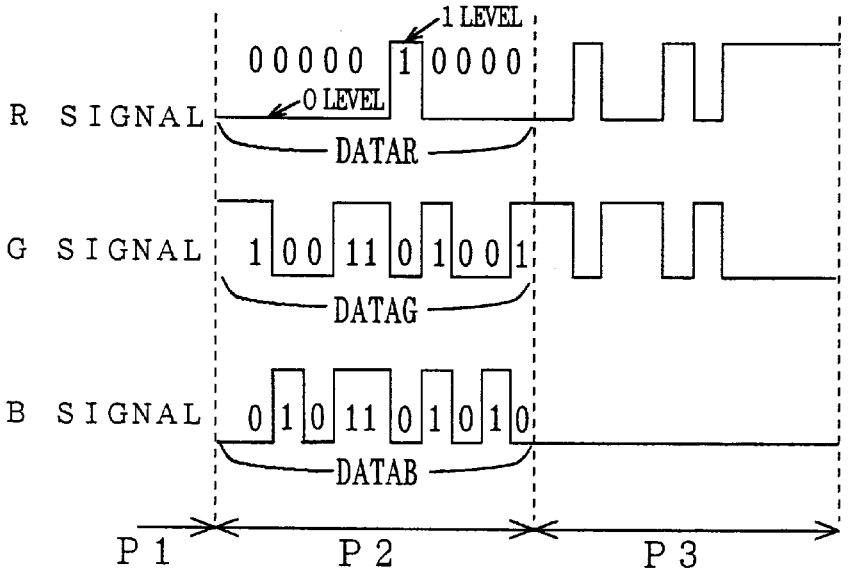
FIG. 6 is a diagram illustrating R, G and B signals output from the shift registers.

The image pattern data DATAR, DATAG and DATAB stored in the shift registers 5*a*, 5*b* and 5*c* during the period P1E are shifted bit by bit in synchronism with the rising edges of the pulses, thereby being output from the shift registers 5*a*, 5*b* and 5*c* during the period P2. FIG. 6 shows the R, G and B signals output from the shift registers 5*a*, 5*b* and 5*c*, respectively.

Thus, the first embodiment can implement displaying a character, a digit or other single image pattern in multicolor mode. This makes it possible, for example, to display icons with finer design, which serves to facilitate the visual perception thereof.

EMBODIMENT 2

Figure 7:
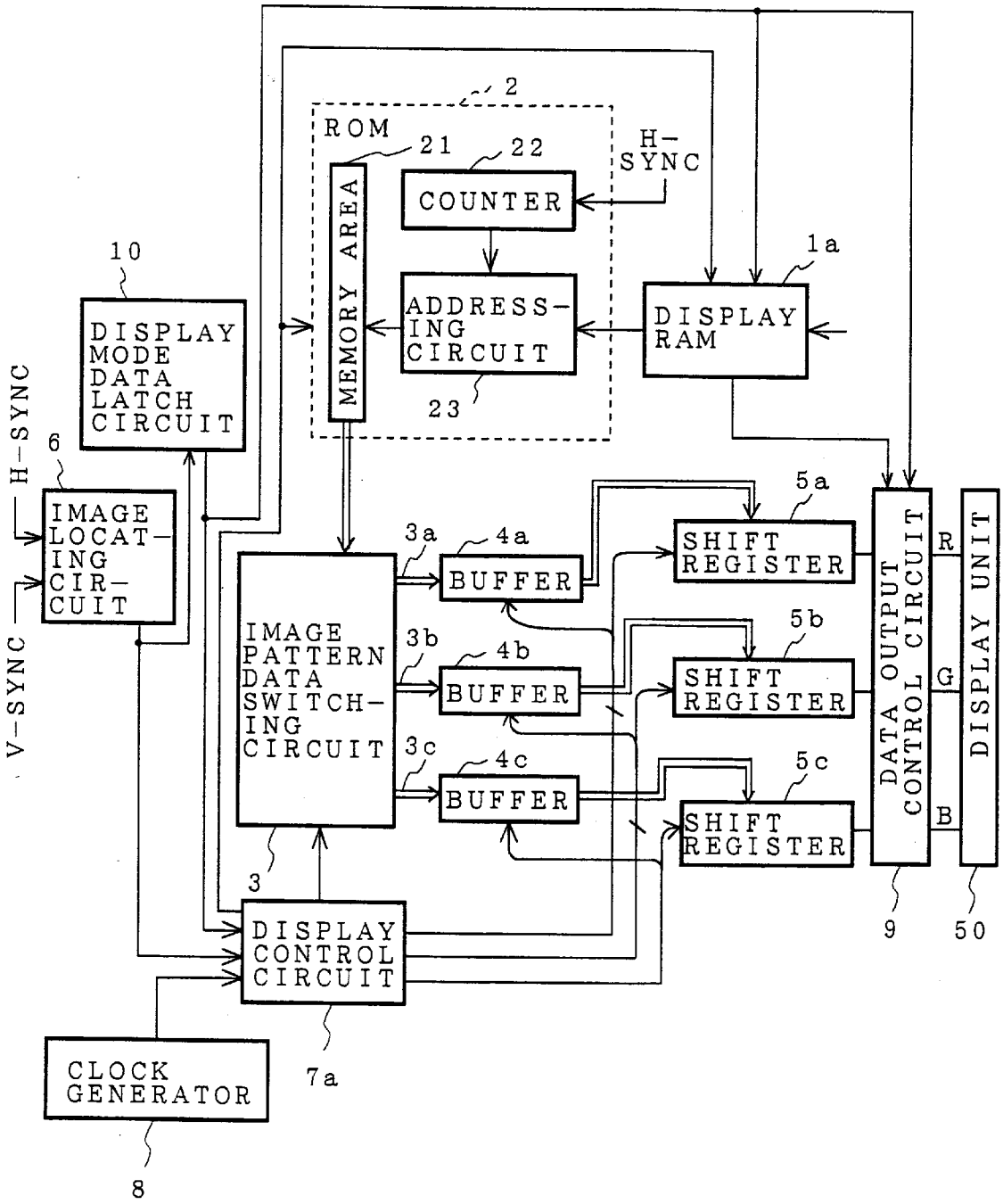
FIG. 7 is a block diagram showing a second embodiment of the image display control apparatus in accordance with the present invention.

FIG. 7 is a block diagram showing the configuration of an embodiment 2 of the image display control apparatus in accordance with the present invention. In FIG. 7, the same or like portions as those of FIG. 1 are designated by the same reference numerals, and the description thereof are omitted here. The embodiment 2 of the image display control apparatus has both a monochromatic display mode and a multicolor display mode. In the monochromatic display mode, each image pattern is provided with one pattern code and one color code so that each image pattern area is colored monochromatically. In contrast, in the multicolor mode, the multicolor display of each image pattern area can be achieved by using the R, G and B pattern codes as described in the embodiment 1.

In FIG. 7, the reference numeral 1*a* designates a display RAM (first memory) for storing data for the monochromatic display mode and data for the multicolor display mode. The reference numeral 7*a* designates a display control circuit (display control means) for controlling the display RAM 1*a*, ROM 2, the image pattern data switching circuit 3, the buffers 4*a*–4*c*, and the shift registers 5*a*–5*c*. The reference numeral 9 designates a data output control circuit (color processing means) which carries out in the monochromatic display mode the color processing of the pattern data output from the shift register 5*a* by using the color data delivered from the display RAM 1*a*, thereby outputting the R, G and B signals, and which delivers in the multicolor mode the outputs of the shift registers 5*a*, 5*b* and 5*c* without change as the R, G and B signals. The reference numeral 10 designates a display mode data latch circuit which stores monochromatic display mode data indicating monochromatic display mode when the display location information from the image locating circuit 6 indicates a display area to be displayed in the monochromatic display mode, and which stores multicolor display mode data indicating the multicolor display mode when the display location information indicates the area to be displayed in the multicolor display mode.

Next, the operation will be described.

First, the display mode data latch circuit 10 latches the monochromatic display mode data in accordance with the location information output from the image locating circuit 6, when an area to be displayed in the monochromatic mode is reached on the screen, whereas it latches the multicolor display mode data when an area to be displayed in the multicolor display mode is reached. The display control circuit 7*a*, the display RAM 1*a* and the data output control circuit 9 recognize the mode by referring to the display mode data latch circuit 10.

Next, a case will be described in which the multicolor mode data is stored in the display mode data latch circuit 10. In this case, the display control circuit 7*a* controls the display RAM 1*a*, ROM 2, the image pattern data switching circuit 3, buffers 4*a*–4*c*, and shift registers 5*a*–5*c*, thereby outputting the R, G and B signals from the shift registers 5*a*–5*c* as described in the embodiment 1. The data output control circuit 9 supplies a display unit 50 with the R, G and B signals delivered from the shift registers 5*a*–5*c* without change.

On the other hand, when the monochromatic display mode data is stored in the display mode data latch circuit 10, the display control circuit 7*a* stops the operation of the buffers 4*b* and 4*c* and shift registers 5*b* and 5*c*, and activates the buffer 4*a* and shift register 5*a*. Then, the display memory RAM 1*a* supplies the ROM 2 with the pattern code for the monochromatic mode. The addressing circuit 23 of the ROM 2 designates the address of the memory area 21 in accordance with the pattern code from the display RAM 1*a* and the count value of the counter 22. The pattern data at the designated address is stored in the buffer 4*a* through the image pattern data switching circuit 3 before the period at which the image pattern data is actually displayed. Then, the image pattern data is transferred into the shift register 5*a* just before the period at which it is actually displayed. Subsequently, the data is read out of the shift register 5*a* in synchronism with the horizontal display pulses when the actual display period begins. The read out image pattern data is fed to the data output control circuit 9 which performs color processing on each image pattern data associated with a character or digit in accordance with the color data delivered from the display RAM 1*a*, and sends it to the display unit 50 as the R, G and B signals.

Thus, the embodiment 2 includes the monochromatic display mode in which the color is designated area by area of the image pattern associated with a character or digit, and the multicolor display mode in which the multicolor display is implemented in each area of the image pattern associated with a character or digit, so that the modes are switched in response to the location of the screen. Accordingly, applying the multicolor mode to only the necessary portions makes it possible to reduce the memory size of the display memory RAM 1*a* and the ROM 2.

EMBODIMENT 3

Figure 8:
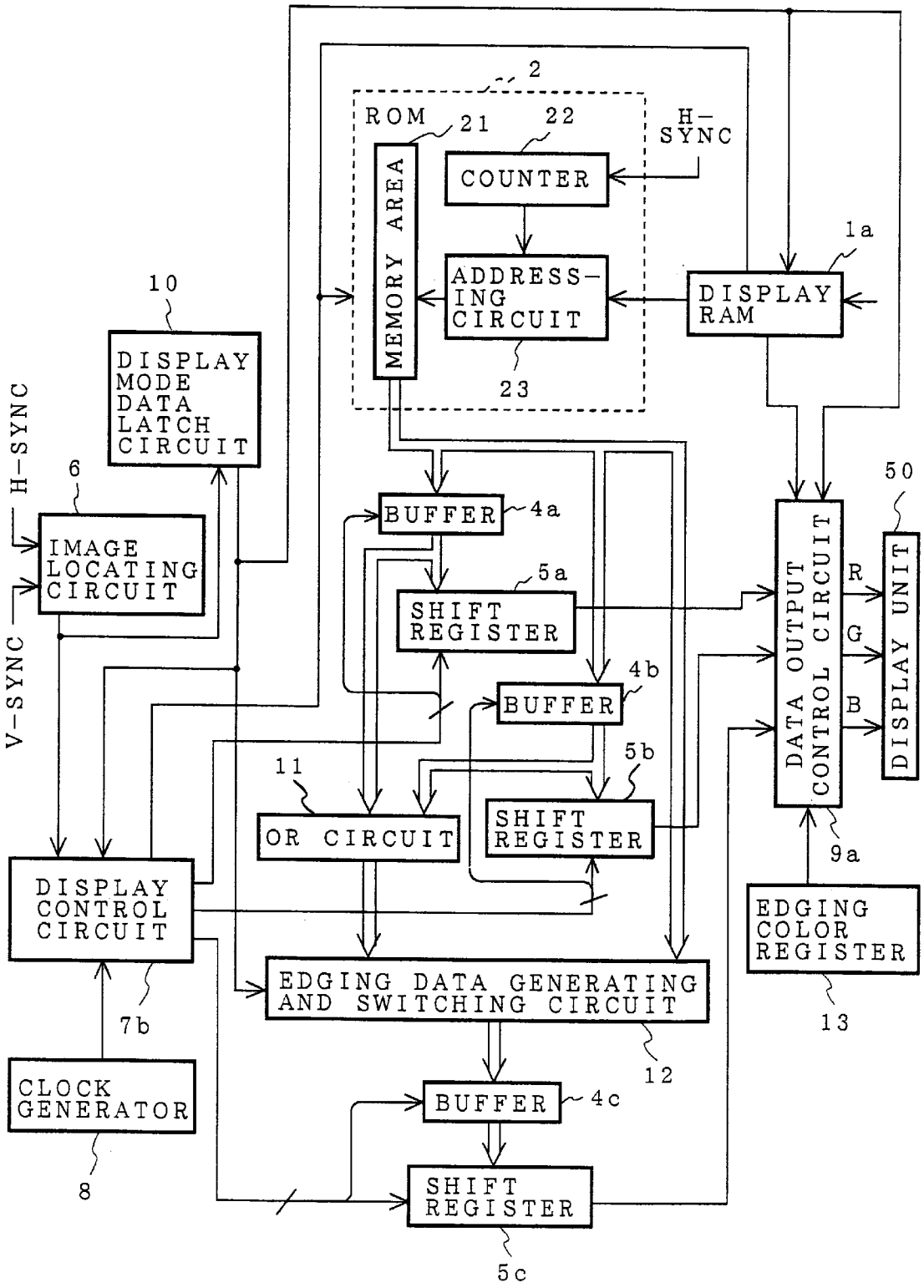
FIG. 8 is a block diagram showing a third embodiment of the image display control apparatus in accordance with the present invention.

FIG. 8 is a block diagram showing the configuration of an embodiment 3 of the image display control apparatus in accordance with the present invention. In FIG. 8, the same or like portions as those of FIG. 7 are designated by the same reference numerals, and the description thereof are omitted here. The embodiment 3 of the image display control apparatus has a monochromatic display mode and a multicolor display mode. In the monochromatic display mode, each image pattern is provided with one pattern code and one color code so that each image pattern area is colored monochromatically. In contrast, in the multicolor mode, the multicolor display of each image pattern area can be achieved by using the R, G and B pattern codes as described in the embodiment 1.

In FIG. 8, the reference numeral 11 designates an OR circuit (edging data generating means) that ORs the image pattern data stored in the buffer 4*a* and the image pattern data stored in the buffer 4*b*. The reference numeral 12 designates edging data generating and switching circuit which generates, in the monochromatic display mode, edging data from the image pattern data output from the ROM 2 and the data output from the OR circuit 11, and which switches, in the multicolor mode, the input data so that the output from the OR circuit 11 is ignored and the image pattern data output from the ROM 2 is delivered to the buffer 4*c* without change. The reference numeral 13 designate an edging color register that stores the data for designating the color of edged portions. The reference numeral 7*b* designates a display control circuit (display control means) for controlling the display RAM 1*a*, ROM 2, buffers 4*a*–4*c* and shift registers 5*a*–5*c* in response to the data stored in the display mode data latch circuit 10. The reference numeral 9*a* designates a data output control circuit (edging display processing means) which supplies, in the multicolor display mode, the display unit 50 with the data output from the shift registers 5*a*–5*c* as the R, G and B signals, and which carries out, in the monochromatic display mode, color control of the image pattern data output from the shift register 5*a* in accordance with the color data output from the display RAM 1*a*, and color control of the image pattern data output from the shift register 5*c* in accordance with the color data stored in the edging color register 13.

Next, the operation will be described.

First, the operation in the multicolor display mode will be described. In the embodiment 3, the R pattern codes, G pattern codes and B pattern codes, which indicate the patterns of the R, G and B signals for each scanning line, are stored in the display RAM 1*a* as in the embodiment 1. The pattern codes together with the count value of the counter 22 are fed to the addressing circuit 23 that designates the addresses of the memory area 21. Thus, the data stored in these addresses are delivered to the buffers 4*a*–4*c*. In the foregoing embodiment 1, the image pattern data corresponding to the R pattern codes, G pattern codes and B pattern codes are stored in the buffers 4*a*, 4*b* and 4*c* through the image pattern data switching circuit 3 before the period at which the data are actually displayed. In the present embodiment 3, however, the image pattern data are fed to the buffers 4*a*–4*c* in common from the ROM 2, and the display control circuit 7*c* controls the storing of the data into the buffers 4*a*–4*c* by producing, in a time sharing fashion, storing control signals that permits the storing of data to the buffers 4*a*–4*c* . Here, the edging data generating and switching circuit 12. supplies the buffer 4*c* with the data output from the ROM 2 without change in the multicolor display mode. Then, the image pattern data stored in the buffers 4*a*–4*c* in the time sharing fashion are stored in the shift registers 5*a*–5*c* just before the period in which the data are actually displayed as in the embodiment 1 . The image pattern data stored in the shift registers 5*a*–5*c* are read out of the shift registers in synchronism with the horizontal display pulses generated by the display control circuit 7*b* during the period in which the pattern data are actually displayed, and are fed to the data output control circuit 9*a*. In the multicolor mode, the data output control circuit 9*a* supplies the display unit 50 with the image pattern data output from the shift registers 5*a*–5*c* without change.

Next, the operation in the monochromatic mode will be described. When the edging is not carried out in the monochromatic mode, the pattern code and the color code are output from the display RAM 1*a*, and the pattern code is fed to the addressing circuit 23 in the ROM 2. The addressing circuit 23 designates the address of the memory area 21 in response to the count value of the counter 22 and the data from the display RAM 1*a* . The image pattern data stored in the designated address is stored in the buffer 4*a* before the period in which the data is actually displayed, and is transferred from the buffer 4*a* to the shift register 5*a* just before the period in which the data is actually displayed. Subsequently, when the actual display period begins, the data in the shift register 5*a* is read bit by bit in synchronism with the horizontal display pulses. The read out image pattern data is delivered to the data output control circuit 9*a* which performs color processing of each image pattern like a character or digit in accordance with the color data delivered from the display RAM 1*a*, and is sent to the display unit 50 as the R, G and B signals.

Figure 9:
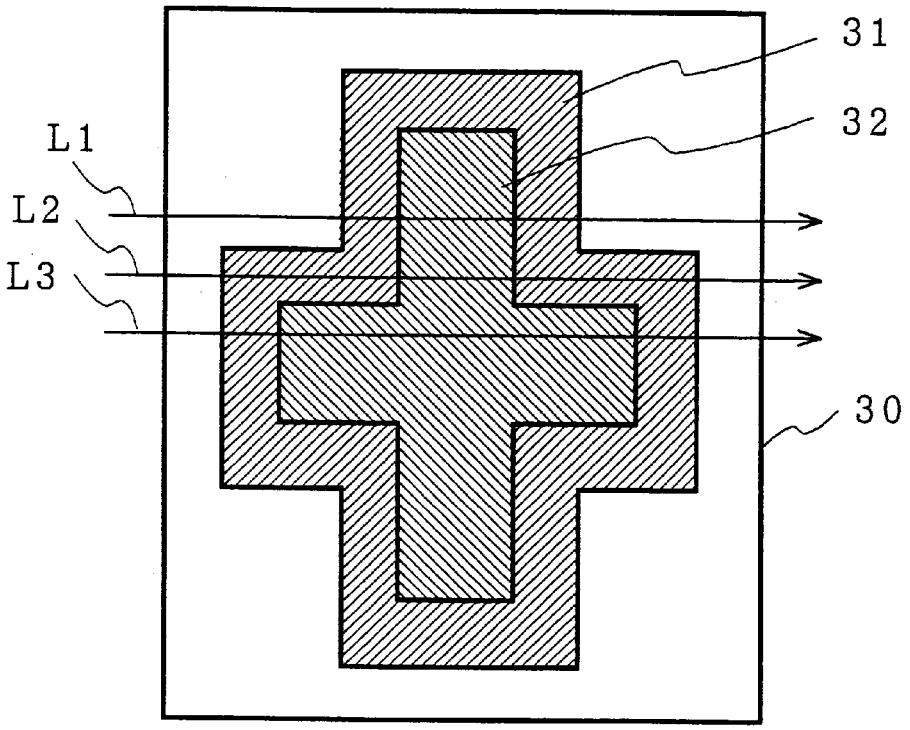
FIG. 9 is a diagram illustrating a display example in which edging processing is performed on an image pattern in the third embodiment in accordance with the present invention.
Figure 10:
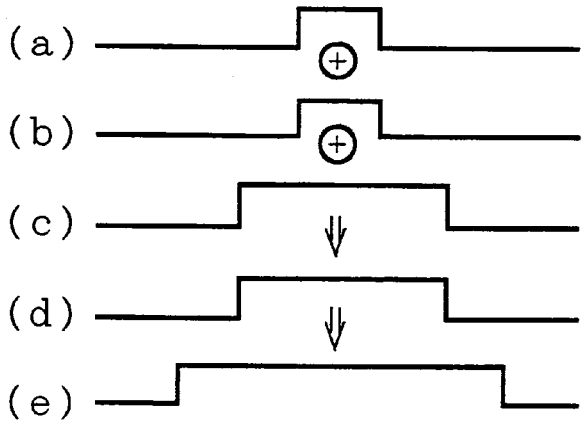
FIG. 10 illustrates waveforms showing steps in which edging data is generated from image pattern data in the third embodiment in accordance with the present invention.
Figure 11:
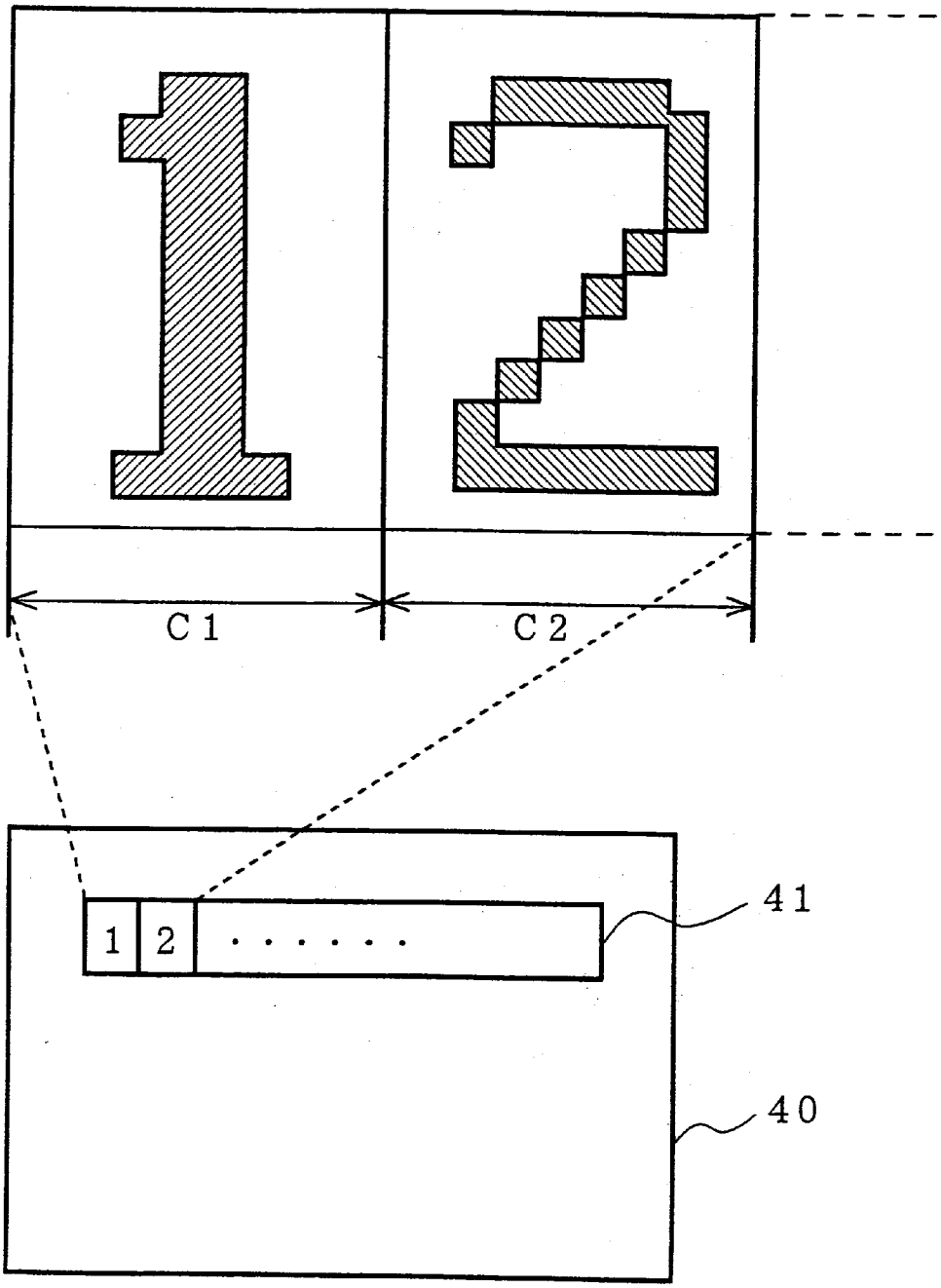
FIG. 11 (PRIOR ART)
FIG. 11 is a block diagram illustrating digits superimposed on a window to be displayed on a display such as a CRT by using a conventional image display control apparatus.

The edging processing in the monochromatic mode will be described. In this processing, the image pattern data corresponding to three consecutive scanning lines are output from the ROM 2 in the time sharing fashion. FIG. 9 illustrates a display example in which an image pattern 32 is provided with an edging pattern 31 in an image pattern display area 30. In FIG. 9. the reference character L1 designates the (n−1)-th scanning line, L2 designates the n-th scanning line, and L3 designates the (n+1)-th scanning line, respectively, where n is a natural number. FIG. 10 illustrates the behavior in which the edging data is generated from the image pattern data along the scanning lines L1, L2 and L3. Waveform(a) illustrates the data along the scanning line L1 of the image pattern 32, waveform(b) illustrates the data along the scanning line L2 of the image pattern 32, waveform(c) illustrates the data along the scanning line L3 of the image pattern 32, waveform(d) illustrates the data obtained by ORing the data from waveform(a) to waveform (c), and waveform(e) illustrates the data obtained by extending the width of the data by one dot to the right- and left-hand sides.

The drawing operation will be described which involves the edging processing of the image pattern data along the scanning line L2 in FIG. 9. In this case, the image pattern data along the scanning lines L1 and L3 adjacent to the scanning line L2 are output from the ROM 2 in the time sharing fashion in addition to the image pattern data on the scanning line L2 before the actual display period. Thus, the image pattern data along the scanning line L1 is stored in the buffer 4*a*, and the image pattern data along the scanning line L2 is stored in the buffer 4*b*. The image pattern data are ORed by the OR circuit 11, and the resultant data is fed to the data generating and switching circuit 12. Following this, the image pattern data along the scanning line L3 is fed to the edging data generating and switching circuit 12, and is ORed with the data output from the OR circuit 11, providing the data as illustrated in waveform(d). Subsequently, the data is extended to the left- and right-hand sides by one bit as illustrated in waveform(e) to be stored in the buffer 4*c*.

Thus, the image pattern data for one line is stored in the buffer 4*b* to be displayed, and the edging data is stored in the buffer 4*c*. The data in the buffers 4*b* and 4*c* are transferred to the shift registers 5*b* and 5*c* just before the period in which the data are actually displayed. The transferred data are delivered to the data output control circuit 9*a* bit by bit in synchronism with the horizontal display pulses generated by the display control circuit 7*b* in the actual display period of the data. The data output control circuit 9 carries out the priority output processing of the image pattern data output from the shift register 5*b* and the edging data output from the shift register 5*c*, and the color processing of the image pattern 32 and the edging pattern 31. Specifically, the color processing of the image pattern 32 is carried out in accordance with the color code output from the RAM 1*a*, and that of the edging pattern 31 is performed in accordance with the color data stored in the edging color register 13. The image pattern display has priority over the edging pattern display so that the image pattern data are output from the data output control circuit 9*a* to the display unit 50 as the R, G and B signals.

Thus, the embodiment 3 can achieve the edging processing in the monochromatic mode.

What is claimed is:

1. A multicolor image display control apparatus comprising:

a first memory for storing a red pattern code, a green pattern code and a blue pattern code, which designate red, green and blue signals, respectively, for each scanning line of an image pattern, said image pattern including a character portion and a background portion;

a second memory including bitmap type red image pattern data, bitmap type green image pattern data and bitmap type blue image pattern data, said red image pattern data, green image pattern data and blue image pattern data corresponding to said red pattern code, green pattern code and blue pattern code stored in said first memory, respectively, for each scanning line of each image pattern, said second memory outputting red image pattern data, green image pattern data and blue image pattern data corresponding to said red pattern code, green pattern code and blue pattern code input to said second memory from said first memory; and output means for sequentially outputting said red image pattern data, green image pattern data and blue image pattern data which are delivered from said second memory in accordance with their color such that pixels in said scanning lines in each character portion of said image pattern can have different colors.

2. The image display control apparatus as claimed in claim 1, wherein said output means comprises a first buffer for temporarily storing said red image pattern data, a second buffer for temporarily storing said green image pattern data, a third buffer for temporarily storing said blue image pattern data, first serial output means for serially outputting data delivered from said first buffer, second serial output means for serially outputting data delivered from said second buffer, and third serial output means for serially outputting data delivered from said third buffer, and wherein said image display control apparatus further comprises display control means for controlling said red image pattern data, green image pattern data and blue image pattern data, which are output from said second memory in time sharing manner, such that they are sequentially stored into said first buffer, said second buffer and said third buffer.

3. The image display control apparatus as claimed in claim 2, wherein said second memory comprises a counter for counting pulses of a horizontal synchronizing signal, and an addressing circuit for addressing bitmap type image pattern data for one line stored in said memory area, in response to a count value of said counter, and said red pattern code, green pattern code and blue pattern code output from said first memory.

4. The image display control apparatus as claimed in claim 2, wherein said display control means controls such that said red image pattern data, green image pattern data and blue image pattern data, which are associated with said image pattern, are stored in said first buffer, second buffer and third buffer, respectively, before a period during which said image pattern is displayed, and controls such that said red image pattern data, green image pattern data and blue image pattern data are output bit by bit from said first serial output means, second serial output means and third serial output means, respectively, during said period.

5. The image display control apparatus as claimed in claim 3, wherein said display control means controls such that said red image pattern data, green image pattern data and blue image pattern data, which are associated with said image pattern, are stored in said first buffer, second buffer and third buffer, respectively, before a period during which said image pattern is displayed, and controls-such that said red image pattern data, green image pattern data and blue image pattern data are output bit by bit from said first serial output means, second serial output means and third serial output means, respectively, during said period.

6. An image display control apparatus comprising:

a first memory for storing a red pattern code, a green pattern code and a blue pattern code, which designate an image pattern;

a second memory including bitmap type red image pattern data, bitmap type green image pattern data and bitmap type blue image pattern data, said red image pattern data, green image pattern data and blue image pattern data corresponding to said red pattern code, green pattern code and blue pattern code stored in said first memory, respectively, said second memory outputting red image pattern data, green image pattern data and blue image pattern data corresponding to said red pattern code, green pattern code and blue pattern code input to said second memory from said first memory;

a first buffer for temporarily storing said red image pattern data;

a second buffer for temporarily storing said green image pattern data;

a third buffer for temporarily storing said blue image pattern data;

first serial output means for serially outputting data delivered from said first buffer;

second serial output means for serially outputting data delivered from said second buffer;

third serial output means for serially outputting data delivered from said third buffer;

display control means for controlling said red image pattern data, green image pattern data and blue image pattern data, which are output from said second memory in time sharing manner, such that they are sequentially stored into said first buffer, said second buffer and said third buffer;

image display mode designating means for designating one of a monochromatic display mode in which an image pattern to be displayed is designated by a single pattern code and a single color code, and a multicolor display mode in which an image pattern to be displayed is designated by a red pattern code, a green pattern code and a blue pattern code; and color processing means for coloring image pattern data;

wherein in said monochromatic display mode, said first memory stores a pattern code and a color code which designate an image pattern, said memory area of said second memory stores bitmap type image pattern data which correspond to said pattern code for designating the image pattern, and said control means controls such that said image pattern data output from said second memory is delivered to one of said first buffer, said second buffer and said third buffer, and said color processing means colors image pattern data output from said serial output means corresponding to said one of the buffers in accordance with said color code stored in said first memory.

7. The image display control apparatus as claimed in claim 6, further comprising edging data generating means for generating edging data for edging in said monochromatic display mode an image pattern in response to image pattern data delivered from said second memory, wherein said display control means controls in said monochromatic display mode said edging data generated by said edging data generating means such that said edging data is stored in a buffer other than said one of the buffers, and such that the stored edging data is output bit by bit from the serial output means corresponding to said buffer other than said one of the buffers, and wherein said image display control apparatus comprises edge display processing means for carrying out edge display processing of the image pattern output from said serial output means corresponding to said one of the buffers in accordance with said edging data.

* * * * *